US006483238B1

(12) United States Patent
Baret et al.

(10) Patent No.: US 6,483,238 B1
(45) Date of Patent: Nov. 19, 2002

(54) PLASMA DISPLAY PANEL HAVING A POROUS STRUCTURE

(75) Inventors: Guy Baret, Grenoble; Jean-Yves Brun, St Martin d'Hers; Pierre Paul Jobert, Nicolas de Macherin; Agide Moi, Seyssins; Yvan Raverdy, Bernin; Serge Salavin, Saint Egreve, all of (FR)

(73) Assignee: Thomson Plasma, Boulogne Billancourt (FR)

( * ) Notice: Subject to any disclaimer, the term of this patent is extended or adjusted under 35 U.S.C. 154(b) by 0 days.

(21) Appl. No.: 09/466,738

(22) Filed: Dec. 17, 1999

(30) Foreign Application Priority Data

Dec. 21, 1998 (FR) ..... 98 16094
Dec. 21, 1998 (FR) ..... 98 16093
Jul. 5, 1999 (FR) ..... 99 08629

(51) Int. Cl.[7] ..... H01J 17/49; H01J 61/02
(52) U.S. Cl. ..... 313/582; 313/587
(58) Field of Search ..... 313/582, 586, 313/587; 345/41, 60

(56) References Cited

U.S. PATENT DOCUMENTS 4,037,130 A 7/1977 Mimitsuka et al. ..... 313/220
4,090,100 A 5/1978 Byrum, Jr. ..... 313/220
5,541,479 A 7/1996 Nagakubo ..... 313/586
6,008,582 A * 12/1999 Asano et al. ..... 313/582
6,023,130 A * 2/2000 Sakasegawa et al. ..... 313/582
6,249,264 B1 * 6/2001 Sano et al. ..... 313/582 X

FOREIGN PATENT DOCUMENTS

JP 01 213942 8/1989 ..... H01J/17/49
JP 04 359837 12/1992 ..... H01J/17/49
JP 07 045200 2/1995 ..... H01J/17/04
WO WO 98/52179 11/1998 ..... G09F/9/35

OTHER PUBLICATIONS

*Patent Abstracts of Japan, vol. 013, No. 525, (E–850) Nov. 22, 1989 (Fujitsu General Ltd.).
**Patent Abstracts of Japan, vol. 017, No. 230 (E–1361) May 11, 1993 (Oki Electric Ind. Co.).
***Patent Abstracts of Japan, vol. 095, No. 005, Jun. 30, 1995 (Noritake Co. Ltd.).

* cited by examiner

*Primary Examiner*—Ashok Patel
(74) *Attorney, Agent, or Firm*—Joseph S. Tripoli; Dennis H. Irlbeck; Carlos M. Herrera

(57) ABSTRACT

The invention applies to plasma display panels consisting of two facing plates enclosing a discharge space and comprising an array of discharge cells ($X_1$, $X_2$, . . . , $X_5$, etc.). A display panel according to the invention has at least one porous layer which contains less than 10% of a hardening agent. The porous layer is either a barrier layer or a gettering layer.

14 Claims, 7 Drawing Sheets

PLASMA DISPLAY PANEL HAVING A POROUS STRUCTURE

FIELD OF THE INVENTION

The present invention relates to plasma display panels (PDPs). More particularly, the invention relates to PDPs having at least one constituent layer whose structure is porous.

BACKGROUND OF THE INVENTION

Plasma display panels are flat display screens in which the displayed image consists of a set of luminous discharge points. The luminous discharges are produced in a gas contained between two insulating plates. Each discharge point is generated by a discharge cell defined by a point of intersection in arrays of electrodes carried by at least one of the plates.

Thus, a PDP comprises a two-dimensional matrix of cells, which is organized in rows and columns copied from the geometry of the electrode arrays. Relief elements, called barriers, may be placed so as to separate the cell rows or the cell columns. In some panels, the barriers may also separate both the cell rows and the cell columns, thus forming a grid pattern of the latter.

The barriers have several functions. By partitioning the space of each cell, at least in the direction of the rows or the columns, the barriers prevent a discharge in one cell causing undesirable discharges in adjacent cells by an ionization effect. They thus prevent crosstalk phenomena.

Moreover, the barriers constitute optical screens between the adjacent cells, making it possible for the radiation emitted by each cell to be well confined in the space. This function is particularly important in colour PDPs in which the adjacent cells constitute respective elementary dots of different colours, for example in order to form triads. In this case, the barriers ensure good colour saturation.

Finally, the barriers often serve as a spacer between the two plates of the panel. What is exploited in this case is the fact that the barriers can have a height which corresponds to the required separation between the two plates and that they are uniformly distributed over the useful area outside the discharge points. In this case, the plate not provided with barriers rests on the tops of the barriers that are present on the other plate. There are also panels in which barriers are present on each of the plates, the plates being joined together with the barriers top against top.

FIGS. 1 and 2 illustrate an AC colour plasma display panel having a so-called coplanar structure, according to a known architecture.

The PDP comprises a first glass plate 2 and a second glass plate 4 a few millimetres in thickness, these being placed face to face with a separation of the order of 100 microns between the internal faces when they are joined together (FIG. 2).

The first plate 2 has, on its internal face, an array of parallel electrodes grouped in closely spaced pairs of electrodes $Y_{1a}$–$Y_{1b}$, $Y_{2a}$–$Y_{2b}$, . . . , $Y_{5a}$–$Y_{5b}$, etc. Each pair of electrodes constitutes a display row of the panel. The electrodes are embedded in a thick layer of dielectric material 6, for example glass, which cover the entire useful area of the plate 2. This layer 6 is itself covered with a thin layer 8 (less than 1 micron in thickness) of another dielectric material, in this case magnesium oxide (MgO), the surface of which is exposed to the discharge gas.

In the example, the internal surface of the first plate 2 may, for example, be provided with a contrast-improving matrix 10. The said matrix consists of a mosaic of elementary colour filters surrounded by generally black rings.

The second plate 4 has, on its internal face, an array of uniformly spaced parallel electrodes $X_1$, $X_2$, . . . , $X_6$, etc., perpendicular to the row electrodes $Y_{1a}$–$Y_{1b}$, $Y_{2a}$–$Y_{2b}$, . . . , $Y_{5a}$–$Y_{5b}$, etc., which constitutes the address electrodes of the plasma display panel. As in the case of the first plate 2, these electrodes $X_1$, $X_2$, . . . , $X_6$, etc. are embedded in a thick dielectric layer 12 which is itself covered with a thin layer of magnesium oxide 14.

A discharge cell of the PDP is thus formed by the intersection of an address electrode $X_1$, $X_2$, . . . , $X_6$, etc. with a pair of electrodes $Y_{1a}$–$Y_{1b}$, $Y_{2a}$–$Y_{2b}$, . . . , $Y_{5a}$–$Y_{5b}$, etc. of a display row.

In operation, an AC voltage, called a sustain voltage, is applied between the electrodes forming the pair of electrodes of each display row. The discharges are produced on the surface between these electrodes according to a voltage signal applied to the address electrode, using well-known multiplexing techniques.

It is especially possible to modify the luminous discharge state of each cell using row-by-row scanning in order to produce a display in video mode.

Straight barriers 16 are placed on the thin layer 14 of the second plate 4 at each place between adjacent address electrodes $X_1$, $X_2$, . . . , $X_6$, etc. and parallel with the latter. The barriers 16 have walls perpendicular to the surface of the plate 4 and a flat top serving as a bearing surface for the internal face of the first plate 2. In some constructions, the barriers may be of trapezoidal cross section so as to improve the luminous intensity. They thus partition the discharge cells in the direction perpendicular to the address electrodes $X_1$, $X_2$, . . . , $X_5$, etc. and serve at the same time as a carrier structure for the spacing of the two plates 2, 4.

Typically, the barriers 16 have a height of the order of 100 microns and a pitch of 220 microns for a 50 micron width.

Phosphors 18R, 18G, 18B are placed in stripes on the exposed surface of the second plate 4. A phosphor stripe covers one surface portion of the thin magnesium oxide layer 14 bordered between two adjacent barriers 16. It also covers the perpendicular walls of the two barriers 16 which are turned towards this surface portion. Each phosphor stripe 18R, 18G, 18B has its own elementary emission colour among red, green and blue in response to a luminous discharge (generally in the ultraviolet) received from a cell. Together, the phosphors constitute a repeat pattern of three successive stripes each having a different emission colour so that a succession of elementary colour triads are created in the direction of the address electrodes, $X_1$, $X_2$, . . . , $X_5$, etc.

The two plates 2 and 4 are sealed together and the space that they contain is filled with the discharge gas at a low pressure, after vacuum pumping through a stem.

It should be noted that the presence of the layers of dielectric material 6, 8 and 12, 14 on top of the electrodes $Y_{1a}$–$Y_{1b}$, $Y_{2a}$–$Y_{2b}$, . . . , $Y_{5a}$–$Y_{5b}$ and $X_1$, $X_2$, . . . , $X_5$, etc. is characteristic of AC PDPs. The dielectric material forms with the electrodes a capacitor across which is applied, in the gas, the voltages necessary to generate and sustain the luminous discharges.

An advantageous feature of AC PDPs is that the AC sustain voltage automatically fixes the state of a luminous discharge point from the last command received, namely either the luminous discharge is maintained or it remains absent, depending on the command previously transmitted. This thus results in an inherent image memory effect, hence the possibility of addressing the points only when their luminous state has to change.

FIG. 3 shows another example of an AC PDP, this time with a matrix structure. This type of PDP differs from coplanar panels essentially by the fact that the discharges are produced between the respective surfaces of the two facing plates 2 and 4.

The components that are analogous between this panel and the one described previously bear the same references.

As in the previous case, the PDP comprises a first plate 2 and a second plate 4, each provided with an array of mutually parallel electrodes $Y_1, Y_2, Y_3, \ldots, Y_7$, etc. and $X_1, X_2, X_3, \ldots, X_7$, etc. which are embedded in a thick layer of dielectric 6 and 12, this layer itself being covered with a thin layer of magnesium oxide 8 and 14. For both plates, the pitch between the electrodes is in the order of 0.5 mm.

The array carried by the first plate 2 constitutes the row of electrodes $Y_1, Y_2, Y_3, \ldots, Y_7$, etc., each display row being associated with a single electrode.

The array carried by the second plate 4 constitutes the column electrodes $X_1, X_2, X_3, \ldots, X_7$, etc., these being placed so as to be perpendicular to the row electrodes.

The second plate 4 also includes a system of barriers 16 in the form of a thick layer (of the order of 100 microns in thickness) in which wells 20 are formed. The wells 20 pass right through the thickness of the layer which constitutes the system of barriers 16 and thus expose the thin MgO layer 14.

When the two plates are joined together, the first plate 2 bears on the layer of barriers 16 via balls 17.

The wells 20 are distributed in a staggered pattern and are centred on crossover points between the row electrodes $Y_1, Y_2, Y_3, \ldots, Y_7$, etc. and the column electrodes $X_1, X_2, X_3, \ldots, X_7$, etc. In the case illustrated, two adjacent row electrodes Y2i and Y2i+1 form a pair and receive the same electrical signal. The wells 20 have a circular cross section of average diameter of the order of 0.5 mm. Each well 20 forms a discharge cell with the crossover of the row electrode and the column electrode with which it is associated. The staggered distribution of the wells 20 means that, along each row electrode $Y_1, Y_2, Y_3, \ldots, Y_7$, etc. there is, in succession, one discharge cell per two points of crossover with the column electrodes $X_1, X_2, X_3, \ldots, X_7$, etc. Likewise, along each column electrode there is, in succession, one discharge cell per two points of crossover with the row electrodes. Thus, 50% of the electrode crossover points on the plate assembly constitute discharge points. According to another construction, it is known to use zigzag electrodes, and in this case half the number of electrodes are used.

Each luminous discharge therefore is produced within a well 20 between the respective exposed MgO layers 8 and 14 of the two plates 2 and 4. The discharge cells are thus perfectly partitioned both in the row direction and in the column direction.

In order to obtain a colour display, phosphors are introduced into the wells 20, each well having a phosphor of primary emission colour different from that of the adjacent wells so as to produce elementary triads in a repeat pattern. The phosphors occupy an annular volume in their wells 20, the central space being left clear in order to create the luminous discharges.

It should be noted that the system of barriers 16 having staggered wells 20 occupies a large part (40 to 60%) of the total area of the second plate 4. It thus allows a strong and stable carrier structure for receiving the spacer balls supporting the first plate 2 to be readily produced.

U.S. Pat. NO. 4,037,130 teaches those skilled in the art that in order to obtain optimized barriers it is preferable for these to be porous. The porosity of the barriers is combined with a gettering effect of the material of which the barriers are composed, in order to remove any parasitic gases that may remain in the panel after pumping.

The gettering effect is a surface absorption property specific to certain materials which can trap certain molecules on their surface. The combination of the gettering effect with the porosity of the material used means that the risk of obtaining a defect due to the outgassing of the materials is almost zero. It is also possible in a plasma display panel to deposit a layer of a gettering material other than the barrier layer.

Whatever the structure used for the barriers 16 or a possible gettering layer, the layer must be made of a hardened material. This is also necessitated when the layer is a layer of barriers intended to be bearing barriers.

This is because bearing barriers have to be able to withstand the considerable force exerted by atmospheric pressure on the plates. During the operation of vacuum pumping the space between the plates 2 and 4 before introducing the low-pressure discharge gas, the force exerted per unit area of barrier may be as much as $10^6$ pascals (approximately 10 kg/cm$^2$) depending on the ratio of the bearing area of the barriers to the total area of the panel.

In the prior art, the barriers 16, like those described with reference to FIGS. 1 to 3 for example, includes an hardening agent, generally a glassy phase, which is sufficiently crush-resistant to maintain a constant space between the two plates.

These barriers are produced, for example, by the screen printing (in 10 to 20 successive layers) of a paste containing a glass frit or by the sand blasting of a layer containing a glass frit.

SUMMARY OF THE INVENTION

After producing the barrier geometry, these layers are fired at temperatures of between 450 and 600° C. so as to solidify the hardening agent and make the layer comprising it mechanically strong.

The invention aims to improve the effects of the barrier layers as well as any layers of gettering material by increasing their porosity so as to eliminate any undesirable outgassing problem after vacuum pumping.

The subject of the invention is a plasma display panel consisting of two facing plates enclosing a discharge space comprising an array of discharge cells, the said panel including a layer of a material which contains less than 10% of a hardening agent. The layer in question is either a barrier layer or, more generally, a layer of a gettering material.

The use of less than 10% hardening agent results in the layer in question being softened. Contrary to what those skilled in the art might think, such softening makes is possible, on the one hand, to ensure the cohesion of the layer and, on the other hand, to guarantee the spacing in the case of bearing barriers. A hardener content of 5% to 10% makes it possible to achieve a compressive strength of the order of $10^6$ pascals (10 kg/cm$^2$). This case corresponds to barriers which cover only 15 to 25% of the area of the panel, this generally being the case in structures such as those described with reference to FIGS. 1 and 2.

According to one particular embodiment, the panel includes a layer of barriers defining staggered wells, the barriers extending from one plate to the other. By reducing the content of hardening agent, the barriers may be sufficiently porous to allow pumping through the barrier layer. The use of a structure consisting of bearing barriers with staggered wells furthermore makes is possible to have a large bearing area, allowing the content of hardening agent to be reduced. It is possible to use a layer containing less than 4% of hardening agent. According to one particular embodiment, no hardening agent is used.

The structure comprising staggered wells and bearing barriers no longer uses balls. It is possible to make use of spacers produced above the barriers, or on the opposite plate, made of the same type of material. Such a technique makes is possible, in particular, to improve the production efficiency by eliminating defects due to the balls rolling while the plates are being joined together.

Moreover, since the barriers contain little hardening agent they have a relatively low density, thereby conferring on them a capacity of undergoing localized compaction when stressed. This characteristic is advantageous when the barriers are bearing barriers. In this case, the plate bearing on the tops of the barriers will level out all the overthicknesses formed during the vacuum treatment (vacuum-pumping cycle), by localized densification of the material.

It is therefore possible to obtain well-controlled spacing of the plates without having to make use of specific techniques aimed at producing great uniformity in barrier height.

In contrast, the relatively rigid barriers used in the prior art must either be dressed or be produced in a process which gives very good height uniformity. This is because any height non-uniformity causes a variation in the spacing between the plates if the barrier is quite solid or causes the barriers to shatter, which may damage the phosphor coatings.

The barriers according to the present invention are preferably composed of a material containing a mineral filler in the form of powder.

In order to ensure maximum porosity while still having good adhesion, the mean elementary diameter of the powder particles preferably lies within the 1 to 20 micron range, and even more preferably the 5 to 8 micron range. A preferred threshold corresponds to a filer consisting of a powder 90% of the mass of which has a particle size such that the particle diameter is greater than 2 microns.

It has been found that a narrow particle size distribution with a mean diameter approximately between 5 and 8 microns is very suitable and gives the deposited layer good cohesion. Barriers resulting from this choice of particle size may withstand a pressure of $5\times10^5$ pascals (approximately 5 $kg/cm^2$) without the addition of a further component and exhibit maximum porosity.

By way of indication, such a compressive strength is sufficient to allow the production of bearing barriers if the latter cover one quarter or more of the area of the panel. This is especially the case for a system of barriers with staggered wells.

Preferably, the layer includes a filler composed of at least one oxide from among: aluminates, alumina, yttrium oxide, yttrium borate, clays, calcium oxide, magnesium oxide, titanium oxide, zirconium oxide or silica. The choice of one or more of these oxides will depend on the gettering effects specific to the materials.

The hardening agent may be a glass, such as a lead or bismuth borosilicate, having a softening temperature below the temperature of the heat treatment or treatments undergone subsequently in the process (lying between 380 and 500° C.).

The hardening agent may also be a silicate, such as sodium silicate, potassium silicate or lithium silicate, etc., or a phosphate, or a carbonate, or a glass based on an oxide of tellurium of silver and vanadium, or else potassium dichromate.

During the heat treatment to burn off the organic binders needed for using these materials, typically comprising a treatment at 380–500° C. for 0.5 to 1 hour, the hardening agent softens or melts and binds the filler particles together, forming bridgings, without creating closed porosity. In the case of silicates, the filler particles are bonded together.

The invention allows all the techniques conventionally used for producing the barriers, such as screen printing, sand blasting, photolithography, etc.

BRIEF DESCRIPTION OF THE DRAWINGS

The invention will be more clearly understood, and further features and advantages will become apparent on reading the description which follows, the description making reference to the appended drawings among which.

DETAILED DESCRIPTION OF PREFERRED EMBODIMENTS

Figure 1:
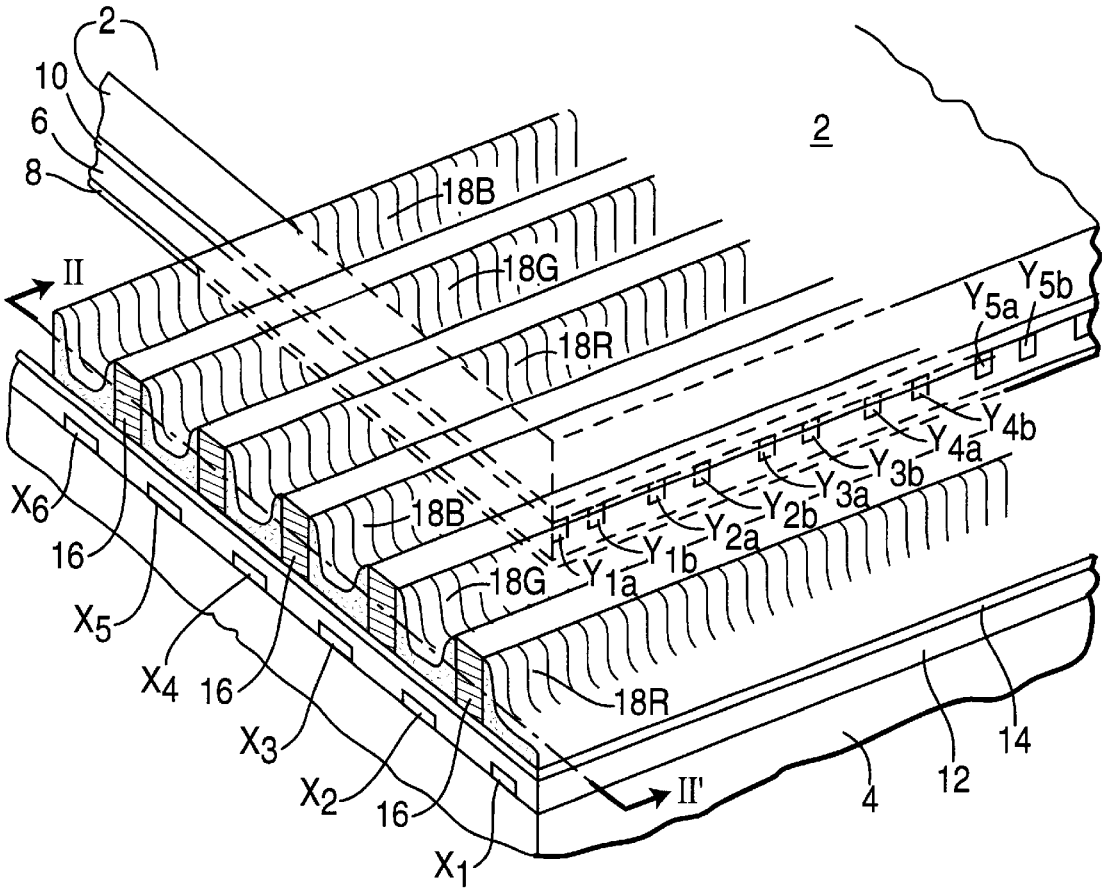
FIG. 1 is a perspective view showing the internal structure of the two plates which make up a coplanar plasma display panel having linear barriers.
Figure 2:
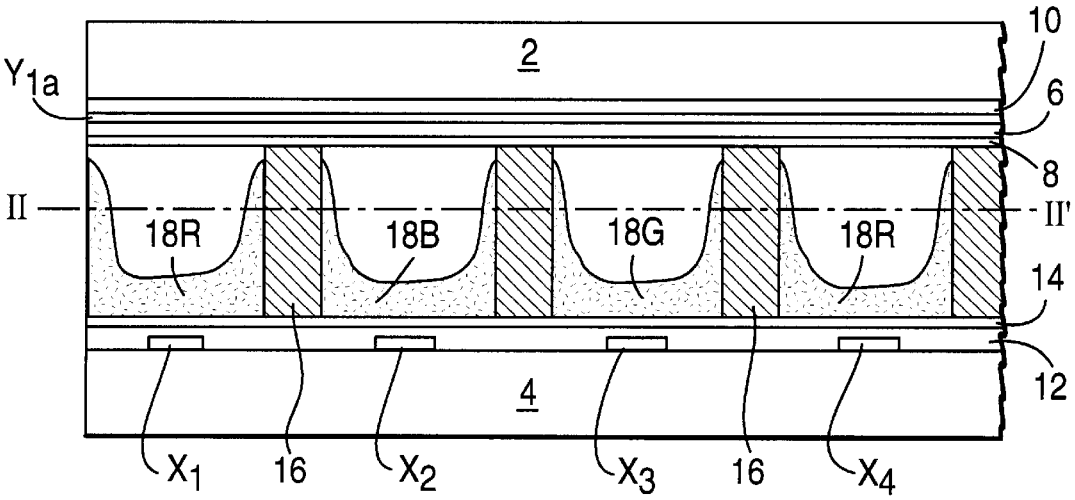
FIG. 2 is a cross-sectional view of the line II–II' in FIG. 1, showing the two plates of the panel joined together.
Figure 3:
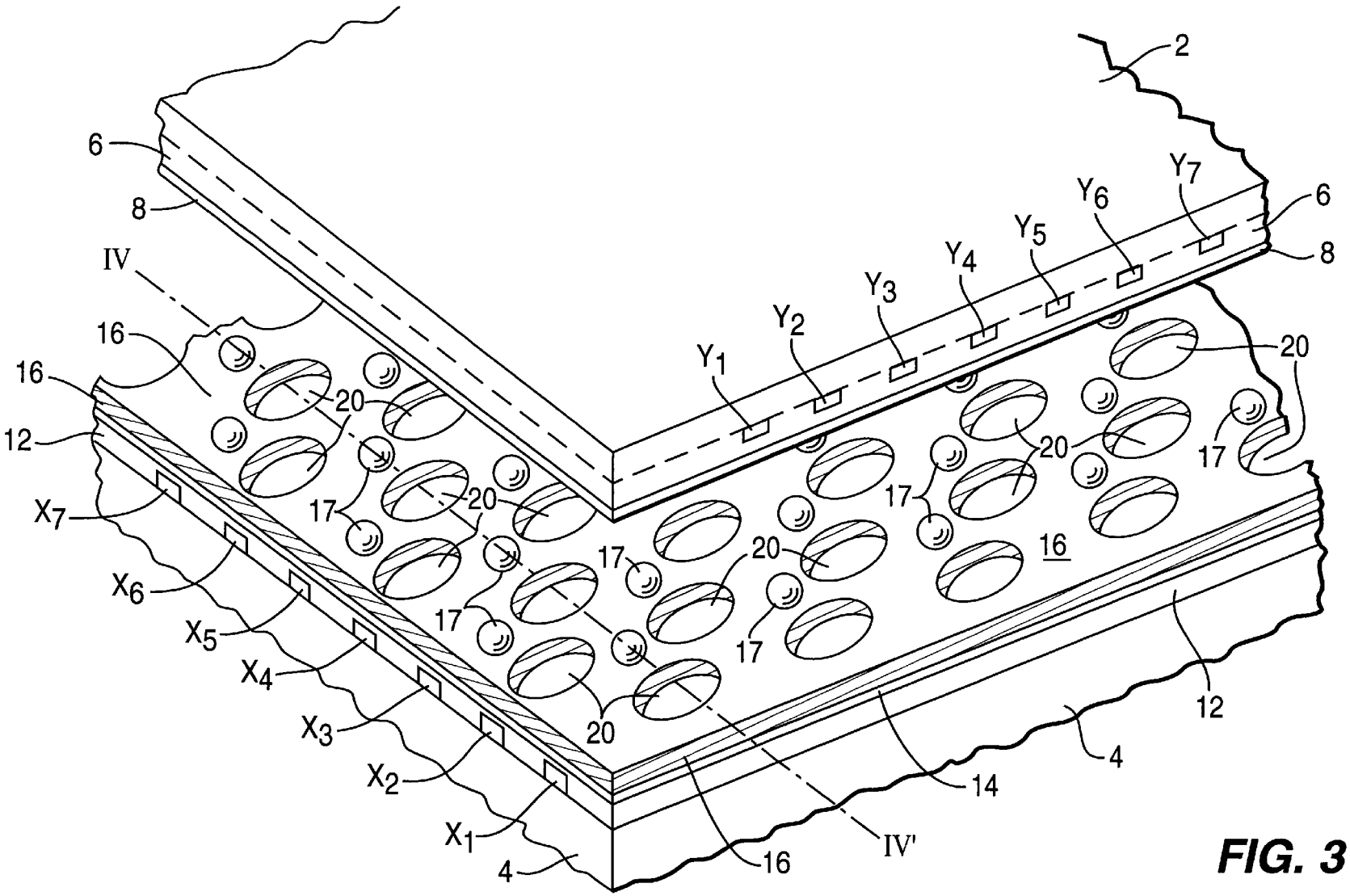
FIG. 3 is a perspective view showing the internal structure of the two plates which make up a matrix plasma display panel having a system of barriers with wells in a staggered pattern.

According to the invention, a first example of the process is based on the manufacture of a plasma display panel as described with reference to FIGS. 1 and 2, having a useful area 106 cm in diagonal, with a TV resolution (560 rows, 700 columns). The barriers 16 are produced on the plate 4 having the address electrodes $X_1$, $X_2$, . . . , $X_5$, etc. They have a pitch of 400 microns, a width of 100 microns and a height of 180 microns.

The operations start on the plate 4 which has been provided beforehand with the array of address electrodes $X_1$, $X_2$, . . . , $X_5$, etc., with the thick layer of dielectric 12 and with the thin layer of magnesium oxide 14 using conventional techniques.

The barriers 16 are produced by the photolithography of a pasty layer 16' deposited by screen printing on the thin MgO layer 14. The composition of the paste forming the layer is as follows:

- a mineral filler in the form of alumina particles having a mean elementary diameter of 5 microns, with a narrow particle size distribution,
- a glassy phase, in this case lead borosilicate ($T_g$=400° C.), at a level of 10% of the mass of the alumina, and
- a negative-type photosensitive resin constituting 50% of the volume of the paste.

Figure 4A:
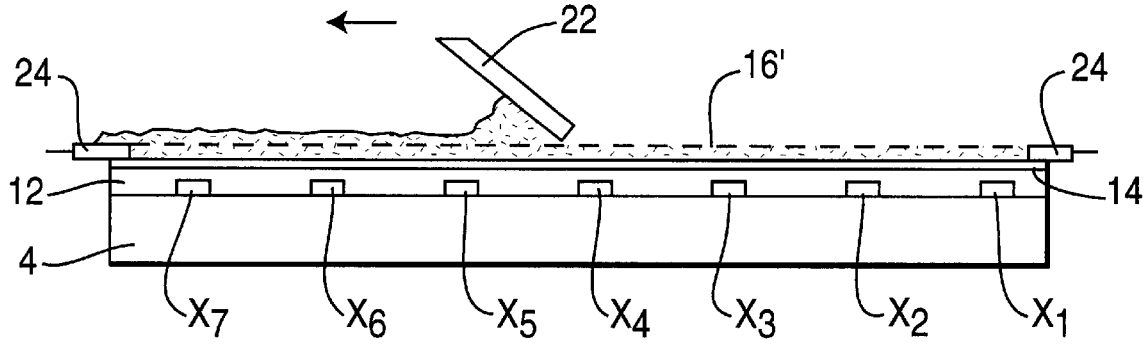
FIGS. 4*a* to 4*c* are cross-sectional views of a plate during various steps of depositing layers forming the barriers, according to a screen-printing deposition process with the formation of patterns by photolithography.

With the aid of a doctor blade 22, the paste 16' is spread uniformly over the MgO layer 14 through a screen-printing mask 24 having an aperture corresponding to the aspect ratio of the useful area of the plate (FIG. 4*a*). The layer of paste 16' has a thickness of the order of 30 microns.

Figure 4B:
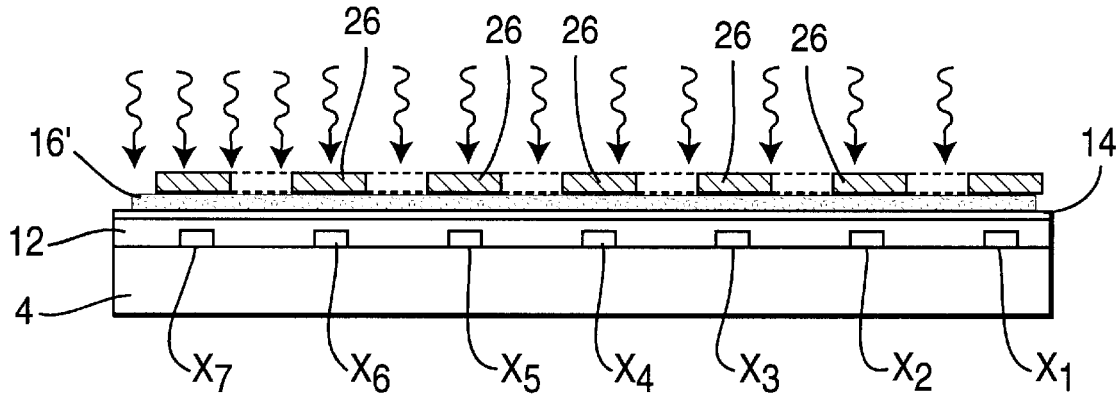

Next, a photolithography mask 26 is placed on the layer of paste 16'. The mask has a pattern of long thin apertures, this pattern being copied from the pattern of barriers to be printed on the MgO layer 14. Those parts of the layer which are revealed through the mask are exposed to ultraviolet radiation so as to make them development-resistant (FIG. 4*b*).

The layer 16' thus exposed is developed in water or in water to which sodium carbonate has been added, depending on the type of resin used, and the surface is then dried with the aid of an air knife.

A first layer of barrier material 16' is therefore obtained with an elementary height of 30 microns.

The steps are repeated in succession until the height required for the barriers 16 is obtained. Each new layer of paste 16' deposited by screen printing completely covers the useful area of the plate, including the tops of the barriers being formed.

Depending on the number of iterations of the steps, the vertical positioning of the screen-printing mask 26 or the depth of the latter are modified in order to take into account the growth in the deposited layers existing on the plate.

Next, the phosphor layers are deposited using screen-printing and photolithography techniques similar to those used for producing the barriers 16. A separate process is used for the three phosphors of different emission colour.

For each of the phosphors, a paste composed of a phosphor filler and a photosensitive resin in a volume ratio of 1:1 is prepared. This paste is deposited uniformly by screen printing on the useful area of the plate in order to form a layer sufficiently thick to embed the barriers.

The photolithography mask has a pattern of cutouts which is copied from the areas that have to be covered by the phosphor stripes.

In general, a single deposition suffices for obtaining the required phosphor thickness.

When all the phosphor stripes have been deposited, the pattern is fired at 420° C. for one hour in order to burn off the organic part. During the firing, the glass frit melts and binds together the alumina powder, forming bridgings between the particles. The porosity of the barriers thus remains high and completely open.

The two plates 2 and 4 are then brought together, by resting the first plate 2 on the tops of the barriers 16 of the second plate 4. Next, the space contained between the two plates is sealed and this space is vacuum pumped through a stem.

The vacuum pumping is carried out at a temperature of 350° C. for 30 minutes only.

Tests have demonstrated that the barriers 16 thus formed withstand pressures of greater than $10^6$ pascals (approximately 10 kg/cm$^2$) and that they undergo no appreciable outgassing during the lifetime of the PDP.

As a variant, the alumina filler may be replaced with another oxide, such as yttrium oxide, silica, titanium oxide or zirconium oxide. It is also possible to produce the barriers using a filler other than an oxide. It is also possible to replace the lead borosilicate with a bismuth borosilicate or any other glass having a sufficiently low softening temperature.

In a second example of the process, the PDP of the first example is produced by using the same processes, but by replacing the lead borosilicate of the plate composition with an equivalent amount of sodium silicate.

Analysis reveals that the sodium silicate also has the effect of forming bridgings between the particles during the firing step. The barriers thus formed also have a high and completely open porosity.

As a variant, it is possible to use, instead of sodium silicate, other silicates: potassium silicate, lithium silicate, etc.

It is also possible to replace the silicates with certain phosphates, such as aluminium phosphate or another phosphate, a potassium dichromate, or with carbonates. More generally, another glassy phase having a low softening temperature, that is to say between 300 and 500° C., may be used.

Of course, these variants may be combined with the variants mentioned in the first example.

Figure 5A:
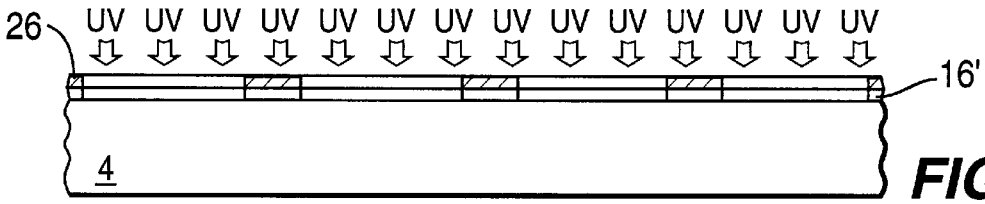
FIGS. 5*a* to 5*g* are cross-sectional views of a plate during various steps in the formation of the barriers, according to one embodiment of the invention.
Figure 5B:
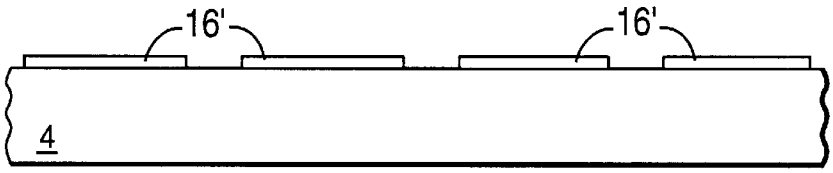
Figure 5C:
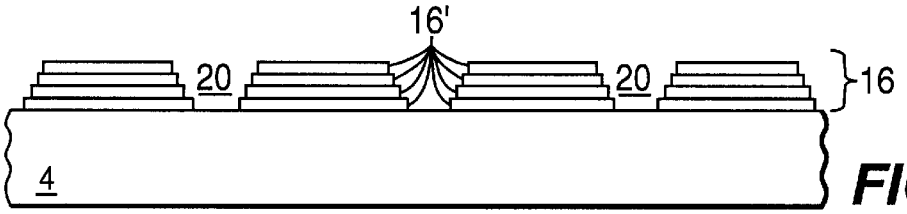
Figure 5D:
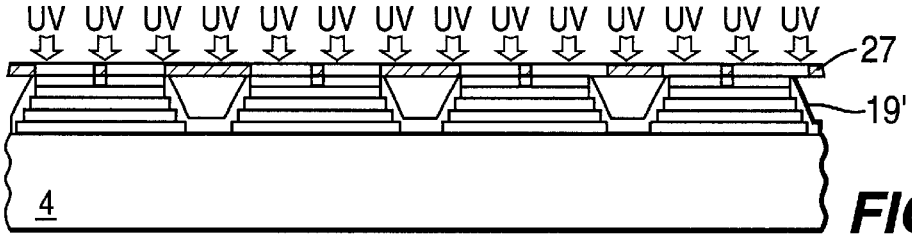
Figure 5E:
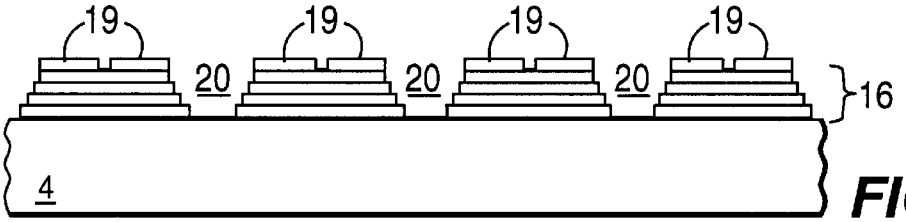
Figure 5F:
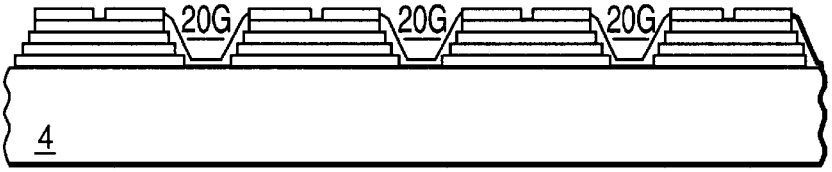
Figure 5G:
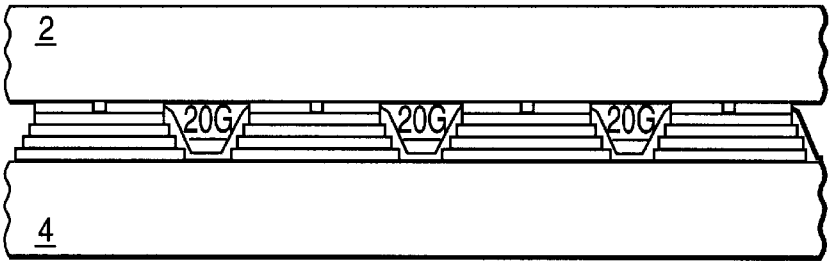
Figure 6:
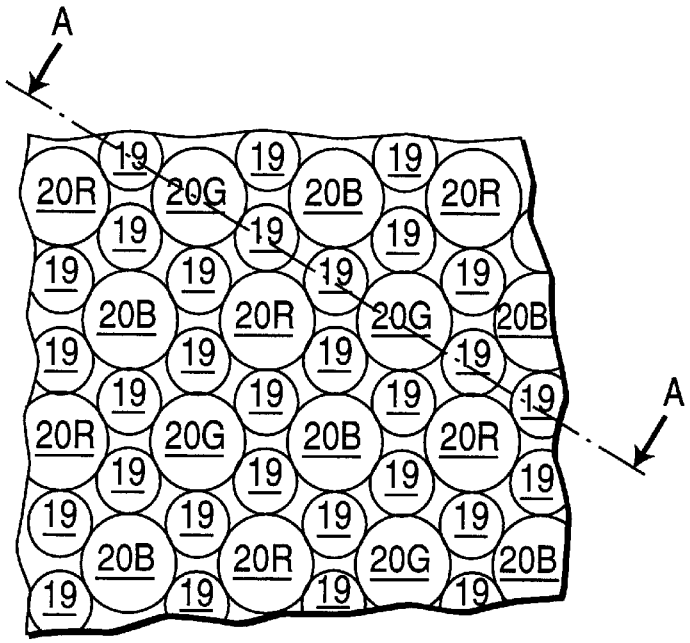
FIG. 6 is a top view of the rear plate corresponding to FIG. 5*f;*

In a third example, a system of barriers having completely open porosity is produced in the manufacture of a PDP having a staggered configuration of wells 20, as illustrated in FIGS. 5*a* to 5*g* and 6. FIGS. 5*a* to 5*g* have been simplified for the sake of clarity and it goes without saying that the plates 2 and 4 illustrated also include electrodes Xi and Yi, dielectric layers 6 and 12 and thin oxide layers 8 and 14 which have not been illustrated. FIGS. 5*a* and 5*g* correspond to a view in the plane of section A—A shown in FIG. 6.

In this case, the system of barriers 16 occupies more than 40% of the area in mount with the front plate 2. The force per unit area (pressure) exerted by the plates on the barriers during vacuum pumping and [sic] therefore approximately 50% less than with the PDP of the first example.

This lower pressure allows a material without a hardening agent to be used for the barriers.

A mineral filler consisting of alumina powder having a narrow particle size distribution and a mean elementary diameter of between 5 and 8 microns is used for the barriers. Such a particle size gives the deposited layer good cohesion.

The alumina powder is mixed with a photosensitive resin in a ratio of 1:1 in order to form a paste.

The paste is deposited uniformly on the layer of magnesium oxide (not illustrated) of the second plate 4 through a first screen-printing mask 24, as in the first example (cf. FIG. 4*a*).

Figure 4C:
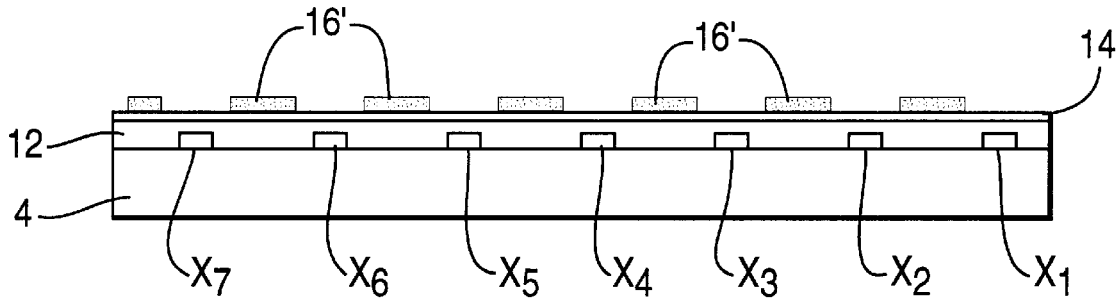

A first photolithography mask 26 having a pattern matching the surface of the system of barriers to be formed is applied on the layer of paste 16' (cf. FIG. 5*a*). The steps of exposure to ultraviolet radiation and of development are then carried out under the conditions of the first example (cf. FIGS. 4*b* and 4*c*) in order to obtain a first barrier layer in a pattern. The first layer has circular apertures approximately 300 $\mu$m in diameter (cf. FIG. 5*b*). A 40 $\mu$m first layer is produced in a single step.

The screen-printing paste deposition and exposure steps are repeated using a mask whose patterns produce holes of increasing diameter and of development. For example, three successive layers 16' 40 $\mu$m in thickness are produced, each layer having circular apertures with a diameter greater than the lower layer, the top layer having circular apertures approximately 500 $\mu$m in diameter (cf. FIG. 5*c*). After successively depositing these layers, a barrier 16 with wells 20 arranged in a staggered fashion is obtained.

A layer 19' of photosensitive alumina paste is then deposited. Next, the layer 19' is exposed to UV with the aid of a mask 27 which defines broad mounts 19, for example having a diameter of 370 μm, on the top of the barrier 16 (cf. FIG. 5*d*). If the barriers are not made of alumina, the same material as the barriers is preferably used for producing the layer 19'.

The phosphors are deposited in the wells 20 formed by the system of barriers 16 by screen-printing steps, thus producing wells 20R, 20G and 20B in a shape of truncated cone. The shape of truncated cone has the advantage of giving high luminosity.

Next, a heat treatment for burning off the organic binders of the layers 16' and 19' is carried out at a temperature of 400 to 500° C. for 0.5 to 1 hour.

At the end of the process, the two plates are sealed and vacuum-pumping is carried out through a stem at a temperature of 350° C. for a period of 30 minutes only.

Tests demonstrate that the system of barriers 16 has sufficient mechanical strength to fulfil the spacing function which can withstand the pressures of the order of 3 to $5\times10^5$ pascals (approximately 3 to 5 kg/cm$^2$).

No undesirable effect due to outgassing was observed during the lifetime of the PDP.

The variants in the composition of the mineral filler which were mentioned in the context of the first example may also be used in the composition of this example.

Another variant consists in using a hardening agent at a very low level, such as potassium dichromate, in order to be able to produce barriers and mount smaller in size. For example, a paste is used which contains, by mass, 49% alumina, 49% polyvinyl alcohol and 2% potassium dichromate, which also acts as a photosensitizer for the polyvinyl alcohol used as photosensitive resin.

Figure 7:
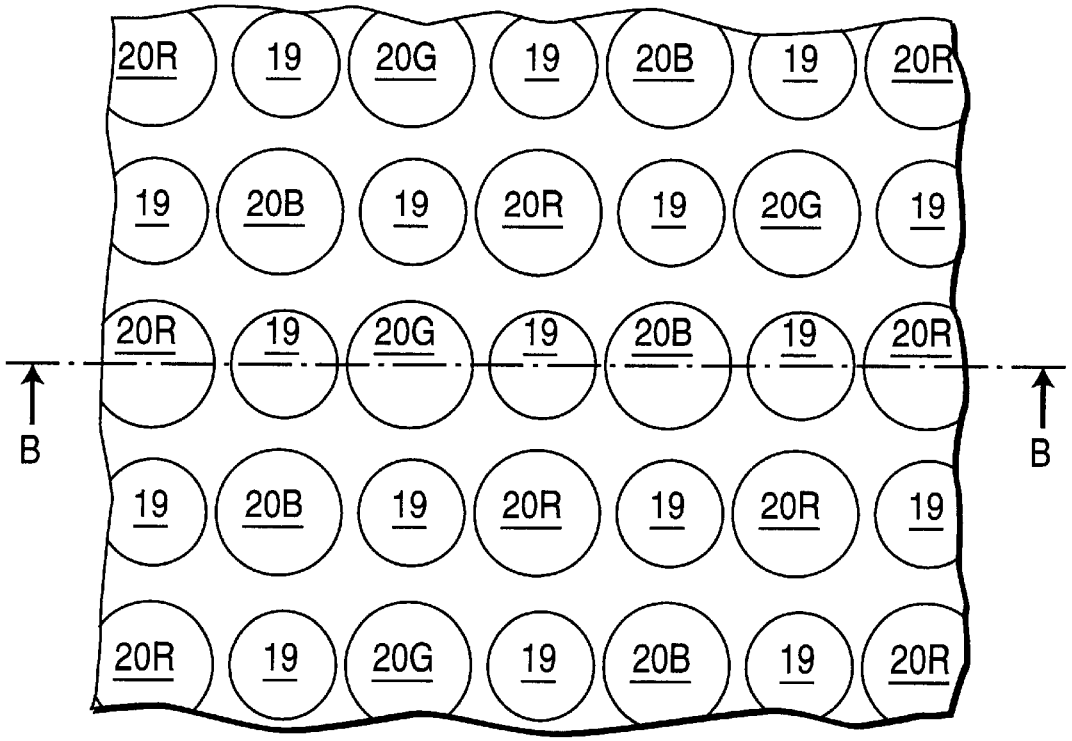
FIG. 7 is a top view of a plasma display panel according to another embodiment of the invention.
Figure 8A:
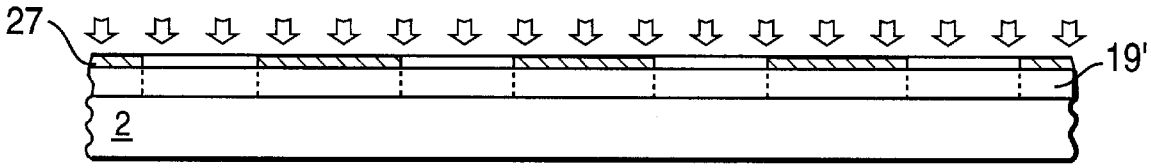
FIGS. 8*a* to 8*e* are cross-sectional views of the plates making up the plasma display panel in FIG. 7.
Figure 8B:
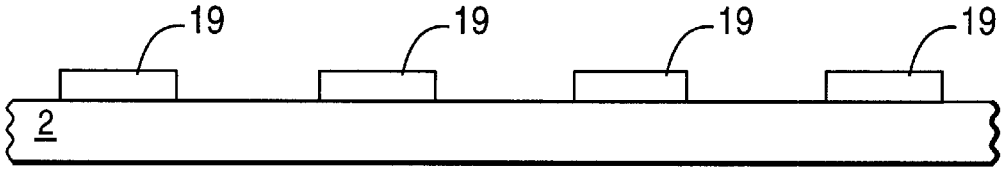
Figure 8C:
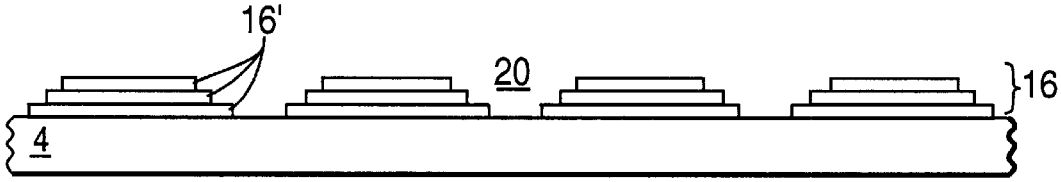
Figure 8D:
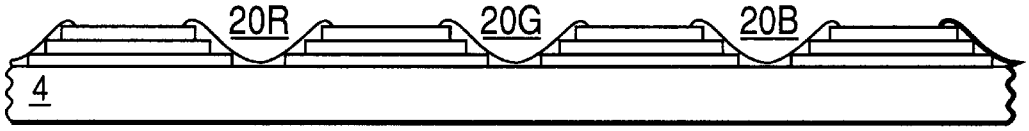
Figure 8E:
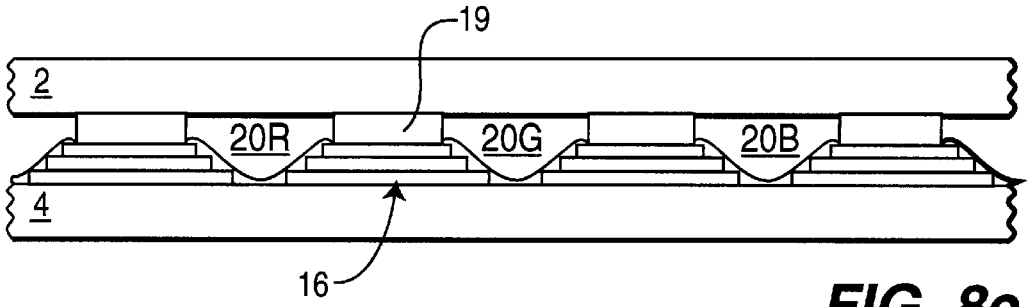

In a fourth example, a system of barrier having completely open porosity and having staggered wells 20 is produced as illustrated in FIG. 7. This fourth example is explained with the aid of FIGS 8*a* to 8*e* which correspond to a view on the section B—B shown in FIG. 7. FIGS. 8*a*and 8*e* are not to scale for representational reasons.

Such a staggered structure corresponds to pixels that are wider than they are tall. The elementary cells have a diameter of approximately 400 μm and are horizontally spaced by 400 μm. The rows of cells are vertically spaced by 465 μm. Mounts 19 having a diameter of 370 μm are placed between the cells.

The structure of this fourth example has the feature of having an upper barrier area of greater than 66% but a bearing area of the order of 29%. In this example, a barrier hardness is used that varies according to the barrier layers 16 or spacer layers 19.

In this fourth example, a layer 19' of a photosensitive alumina paste is deposited on the front plate 2, this paste being composed, for example, of 47% alumina powder having a narrow particle size distribution, the diameter of the particles of which is between 5 and 8 μm, 5% hardening agent, for example lead borosilicate, and 48% photosensitive resin. The thickness of the deposited layer is, for example 50 μm. After the layer 19' has been deposited, it is exposed with the aid of a mask 27 corresponding to the spacer mounts, as indicated in FIG. 8*a*. The expression "narrow particle size distribution" should be understood to mean that there are no small-sized particles. The requirement is for a minimum of 90% of the particles to have a diameter greater than 2 μm. Obviously, it is preferable to reduce as far as possible the small-sized particles, that is to say less than 1 μm, since they reduce the porosity of the material after firing.

After exposure, the layer 19' is then developed in water so as to obtain broad mounts 19 which are fired at a temperature of approximately 400° C. for approximately 30 min.

A barrier structure 16 made of several layers 16' (see FIG. 8*b*) is produced on the rear plate 4 as explained in the case of the third example. The diameter of the wells 20 varies, for example, from 200 μm to 400 μm in three layers 6', each having a thickness, for example, of 40 μm.

However, the lower layers 16' are produced without a hardening agent using a paste containing 50% alumina and 50% photosensitive resin whereas the top layer 16' is produced from a paste containing 48% alumina, 3% hardening agent and 49% photosensitive resin. The hardening agent employed is preferably the same as the hardening agent employed for the layer 19'.

After the barriers 16 have been deposited and formed, the phosphors are deposited in order to produce the various elementary cells 20R, 20G and 20B. The whole assembly is fired at approximately 400° C. for approximately 30 min. as indicated in FIG. 8*d*.

The variants in the composition of the mineral filler which were mentioned in the first example may also be used in the composition of this example.

Next, the two plates 2 and 4 are joined together, the mount 19 coming into mount with the top surface of the barriers 16, as shown in FIG. 8*e*. Vacuum pumping is then carried out for a period of 30 min. at a temperature of 350° C.

Very many variants of the invention are possible without departing from the scope of the invention. Those skilled in the art may have the option of varying the shapes and sizes of the structures given by way of example.

In addition, according to different variants, the alumina may be partly or completely replaced with different materials whose properties are similar. Alumina has the advantage of having a large gettering effect with respect to water and $CO_2$. Of course, those skilled in the art may replace the alumina with calcium oxide or an aluminate whose gettering effects are equivalent.

More generally, it is recommended to use the largest gettering effects. The troublesome gases, the outgassing of which causes disturbances in a plasma display panel, are water, carbon monoxide and carbon dioxide. Oxygen may also degas, but it is less troublesome for the operation of the panel.

As material having a gettering effect with respect to water, it is possible to use, as required, alumina, aluminates, clays, or calcium, magnesium or yttrium oxides, silica, or silicates.

As material having a gettering effect with respect to water, it is possible to use, as required, alumina, aluminates, clays, or calcium, magnesium or yttrium oxides, silica, or silicates.

Titanium oxide and yttrium oxide have a gettering effect with respect to oxygen. It is possible to mix the various materials, reduced to powder, so as to combine the various gettering effects.

Advantageously, a material having a high secondary emission coefficient is used in the filler in order to improve the light efficiency. For this purpose, yttrium-based oxides or yttrium borate are preferred.

According to a variant of the invention, a layer of one or more gettering materials is deposited inside the panel so as to trap any undesirable residual gases. Such a layer may be deposited under the phosphors or around the perimeter of the image area. The function of this layer then becomes independent of its structure.

Figure 9B:
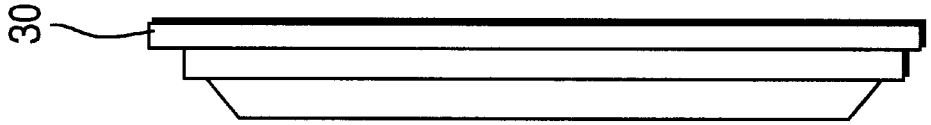
FIGS. 9*a* and 9*b* illustrates a plasma display panel produced according to the invention.
Figure 9A:
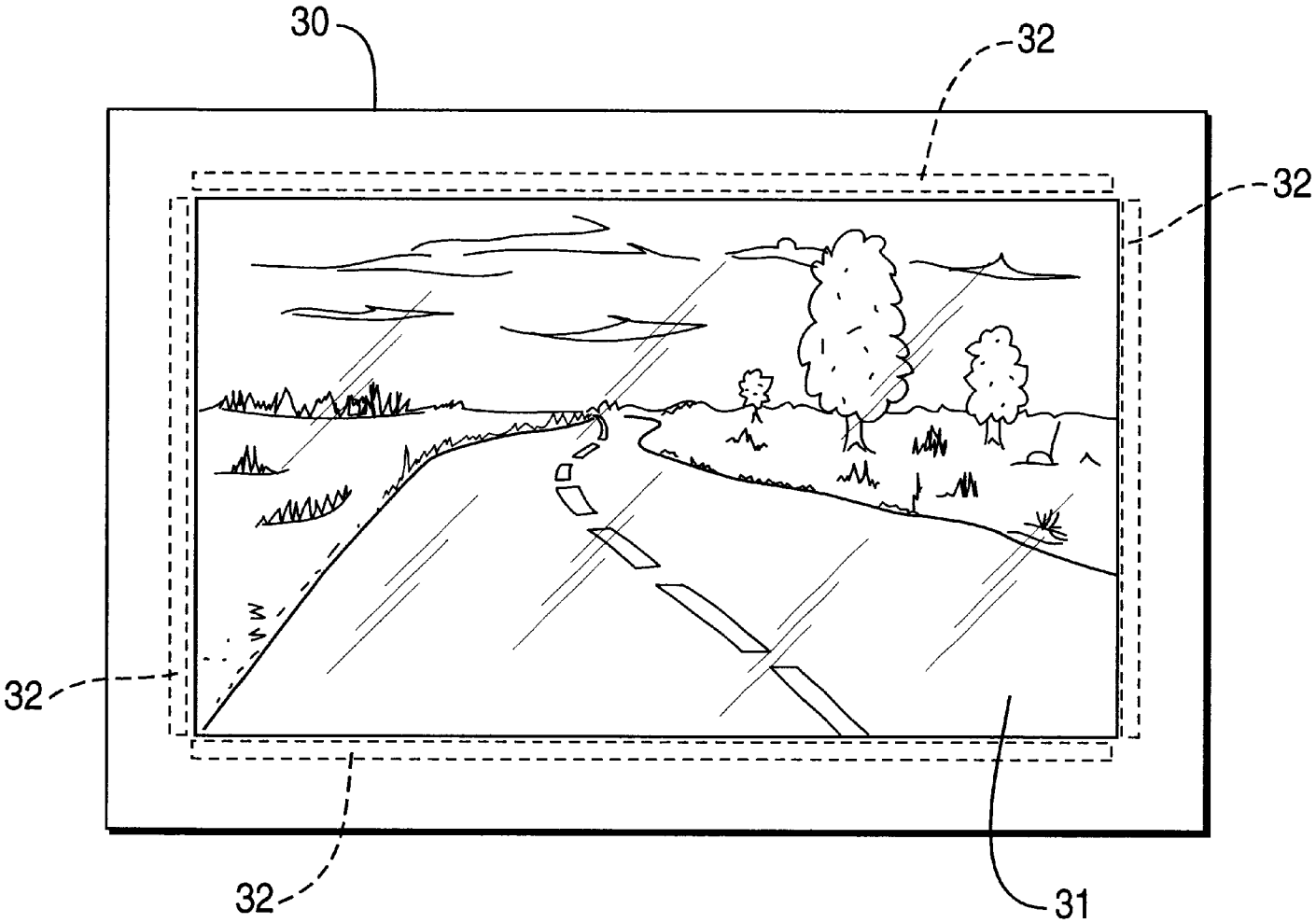

FIGS. 9*a* and 9*b* illustrates a plasma display panel 30 seen from the front and from the side. The panel 30 has an image area 31 whose diagonal is, for example, 42 inches, i.e. approximately 106 cm. Illustrated by the dotted lines are absorption regions 32 which are arranged around the perimeter of the image area 31 but said regions 32 share the same confined space between the two plates 2 and 4. The absorption regions 32 have, for example, a width of one centimeter.

The layer of gettering material forming the absorption region 32 preferably has a high porosity so as to increase the useful surface area for gettering. However, if the risks of outgassing are low, especially because porous barriers are used, it is possible to use a layer of material having low porosity for the absorption regions.

Such a variant may also be applied in panels which do not use a porous barrier structure. In this case, it is even recommended to produce absorption regions 32 in order to compensate for the greater outgassing than with porous structures.

Such a layer is produced in the same way as a barrier layer is deposited according to one of the preceding examples.

It should be noted that the invention applies to all types of plasma display panels using barriers, whether or not these are bearing barriers. Although the examples given relate to AC plasma display panels, it is clear that they may also be adapted to DC panels.

What is claimed is:

1. Plasma display panel consisting of two facing plates enclosing a discharge space comprising an array of discharge cells, wherein at least one porous layer of a material is comprised between the two plates, and wherein the material contains less than 10% of a hardening agent.

2. Panel according to claim 1, wherein the hardening agent is a glassy phase having a low softening temperature from the group consisting of, a lead of bismuth borosilicate, a silicate, a phosphate, a carbonate, a potassium, and dichromate.

3. Panel according to claim 1, wherein the materials comprises materials having Getter effect.

4. Panel according to claim 1, wherein the material includes a filler composed of at least one oxide from among: aluminates, clays, calcium oxide, yttrium borate and zirconium oxide.

5. Panel according to claim 4, wherein the filler furthermore includes alumina or yttrium oxide.

6. Panel according to claim 4, wherein the filler consists of a powder, 90% of the mass of which has a particle size such that the particle diameter is greater than 2 microns.

7. Plasma display panel comprising:

two plates facing each other, the plates enclosing a discharge space comprising an array of discharge cells;

at least one bearing porous barrier layer, extending between the two plates and separating the discharge cells, wherein the barrier layer is made of a material comprising a filler and a hardening agent, and wherein the material contains less than 10% of the hardening agent.

8. Panel according to claim 7, wherein the hardening agent is a glassy phase having a low softening temperature from the group consisting of, a lead or bismuth borosilicate, a silicate, a phosphate, a carbonate, a potassium, and dichromate.

9. Panel according to claim 7, wherein the filler comprises materials having a Getter effect.

10. Panel according to claim 7, wherein the filler is composed of at least one material from the group consisting of, alumina, aluminates, clays, calcium oxide, yttrium oxide, yttrium borate and zirconium oxide.

11. Panel according to claim 7 wherein the filler consists of a powder.

12. Panel according to claim 7, wherein 90% of the mass of the filler has a particle size such that the particle diameter is greater than 2 microns.

13. Plasma display panel comprising:

two parallel plates separated by a porous barrier layer defining wells between the two plates arranged in a staggered fashion, wherein the wells form a discharge space between the two plates and the porous barrier layer is made of a material comprising less than 4% of a hardening agent.

14. The plasma display according to claim 13, wherein the porous barrier layer occupies more than 40% of the surface area of one of the two plates.

* * * * *